US005699247A

United States Patent [19]

Moriya et al.

[11] Patent Number: 5,699,247

[45] Date of Patent: Dec. 16, 1997

[54] FUZZY CONTROL SYSTEM AND METHOD FOR HYDRAULIC BACKHOE OR LIKE EXCAVATOR

[75] Inventors: Naoyuki Moriya, Kobe; Makoto Samejima; Yujiro Shimizu, both of Takasago, all of Japan

[73] Assignee: Shin Caterpillar Mitsubishi, Ltd., Tokyo, Japan

[21] Appl. No.: 726,882

[22] Filed: Jul. 8, 1991

[30] Foreign Application Priority Data

Jul. 25, 1990 [JP] Japan ..... 2-194833

[51] Int. Cl.[6] ..... G06F 7/70; B66C 23/00; E02F 5/02

[52] U.S. Cl. ..... 364/424.07; 364/167.01; 364/423.098; 37/348; 414/694; 414/699; 172/4.5

[58] Field of Search ..... 364/424.07, 167.01, 364/423.098; 395/61, 900, 3, 60, 66, 76, 81, 85, 80, 99; 37/DIG. 1, DIG. 20, 348, 347, 905, 419, 443; 172/2, 4.5, 3, 812, 7; 340/686; 414/694, 699, 700, 707

[56] References Cited

U.S. PATENT DOCUMENTS

| | | | |
|---|---|---|---|
| 4,332,517 | 6/1982 | Igarashi et al. | 364/424.07 |
| 4,377,043 | 3/1983 | Inui et al. | 414/699 |
| 4,627,013 | 12/1986 | Ichiyuma et al. | 364/567 |
| 4,805,086 | 2/1989 | Nielsen et al. | 364/167.01 |
| 4,866,641 | 9/1989 | Nielsen et al. | 414/699 |
| 4,910,673 | 3/1990 | Narisawa et al. | 364/424.07 |
| 5,025,499 | 6/1991 | Inoue et al. | 364/165 |
| 5,047,701 | 9/1991 | Takarada et al. | 318/568.1 |
| 5,065,326 | 11/1991 | Sahm | 364/424.07 |
| 5,116,186 | 5/1992 | Hanamoto et al. | 414/694 |
| 5,359,517 | 10/1994 | Moriya et al. | 364/424.07 |

FOREIGN PATENT DOCUMENTS

| | | |
|---|---|---|
| 0 288 314 | 10/1988 | European Pat. Off. . |
| 0 380 665 | 8/1990 | European Pat. Off. . |
| 0 512 584 A2 | 11/1992 | European Pat. Off. . |
| 9007032 | 12/1988 | WIPO . |

OTHER PUBLICATIONS

Patent Abstracts of Japan, vol. 9, No. 98 (M-375) (1821) 27 Avril 1985 & JP-A-59 220 534 (Komatsu Seisakusho K.K.) 12 Dec. 1984.

Patent Abstracts of Japan, vol. 10, No. 10 (M-446) (2067) 16 Janvier 1986 & JP-A-60 172 712 (Hitachi Kenki K.K.) 6 Sep. 1985.

Prof. Dr. Theiner, Kollege Microchip fährt mit, bd baumaschinendienst—Heft 3—Mar. 1988, pp. 144–148 with.

*Primary Examiner*—Jacques Louis-Jacques
*Attorney, Agent, or Firm*—Foley & Lardner

[57] ABSTRACT

A system for controlling the cutting operation of a hydraulic backhoe having a bucket pivotally joined to one end of an arm, the other end of which is pivotally joined to one end of a boom having another end pivotally supported on a self propelled vehicle. Hydraulic jacks are provided for pivoting the boom relative to the vehicle, the arm relative to the boom, and the bucket relative to the arm. During each cutting operation the actual bucket speed relative to the arm and the actual arm speed relative to the boom are sensed and referred to a set of fuzzy control rules for obtaining command values for controlling the boom, arm and bucket jacks. The fuzzy control rules are so determined and utilized as to enable the machine to automatically take a cut in a manner suiting the hardness or other characteristics of the soil.

5 Claims, 5 Drawing Sheets

FUZZY CONTROL SYSTEM AND METHOD FOR HYDRAULIC BACKHOE OR LIKE EXCAVATOR

BACKGROUND OF THE INVENTION

The present invention relates to an apparatus and a method for automating the cutting operation of a hydraulic backhoe or like excavator. The automatic control system according to the invention operates on the basis of fuzzy reasoning for closely approximating the cutting operation of a desired earthmover to that heretofore considered possible only when the machine is manipulated by a veteran operator.

The hydraulic excavator may be thought of as a combination of a self propelled vehicle and a front end attachment. The vehicle resolves itself into a track undercarriage and, pivotally mounted thereon, an upper frame including an operator's cabin. The front end attachment comprises a boom operatively supported on the vehicle via a bucket actuating linkage. The bucket actuating linkage comprises a boom pivoted at one end on the vehicle, and a stick pivotally joined at one end to the other end of the boom and at the other end to the bucket. Hydraulic cylinders or jacks are provided for pivoting the boom relative to the vehicle, the stick relative to the boom, and the bucket relative to the stick. Hydraulic motors are employed for driving the vehicle and revolving the frame relative to the undercarriage.

Until the recent advent of electronic control systems, the operation of hydraulic excavators of the above outlined construction had long been purely manual. The operator had had to manipulate many levers within the cabin. However, as the shortage of skilled workers became more and more serious in the construction industry, demands grew stronger for the greater ease of operability of earthmovers. Electronic control systems have thus been developed and built into the machines for automating their cutting operations.

As heretofore suggested and put to practice, a typical control system for hydraulic excavators comprised sensors for ascertaining the angular positions of the upper vehicle frame relative to the undercarriage, of the boom relative to the frame, of the stick relative to the boom, and of the bucket relative to the stick. The output signals from these sensors were fed to a bucket position calculator, which then geometrically computed the current tip position and attitude of the bucket. The bucket tip position and attitude data were introduced in o a controller. As the desired start position and end position of a cut to be taken were manually input to the controller, it controlled the hydraulic jacks and motor so that the bucket might take the cut along a desired locus which might be either linear or curved. The operator was free to choose between manual and automatic cutting modes.

Although the prior art system succeeded in automating cutting operations, it was unsatisfactory for the uniformity or inflexibility of bucket movement in the face of various types of soil to be cut. Any skilled operator can "feel" the properties (hardness, viscosity, etc.) of the soil as the bucket cuts into it. Accordingly, he manipulates the levers in a manner he empirically knows to be best suited for the particular type of soil for the most efficient cutting operation involving the least waste of energy. However, in the prior art system, bucket movements were controlled so as to trace a predetermined locus regardless of the natures of the soil to be cut. No efficient cutting operation could therefore be possibly expected of the conventional control system.

SUMMARY OF THE INVENTION

The present invention represents an application of fuzzy reasoning to the automatic control of a hydraulic excavator, introducing the empirical knowledge of veteran operators into the fuzzy control system so that the excavator may automatically take cuts as efficiently under the control of unskilled operators as when the machine is manipulated by skilled operators.

Broadly, the invention is directed to an excavator having a boom pivotally coupled at one end to a vehicle, an arm or stick pivotally connected at one end to another end of the boom, a bucket pivotally connected to another end of the arm, boom actuator means for pivoting the boom relative to the vehicle, arm actuator means for pivoting the arm relative tot he boom, and bucket actuator means for pivoting the bucket relative to the arm. Typically, the boom actuator means, the arm actuator means and the bucket actuator means all take the form of double acting hydraulic cylinders or jacks.

For automatically controlling the cutting operation of the excavator outlined above, there are provided sensor means for providing position signals indicative of the angular positions of the boom relative to the vehicle, of the arm relative to the boom, and of the bucket relative to the arm. Converter means is connected to the sensor means for translating the position signals into speed signals indicative of the traveling speeds of the boom relative to the vehicle, of the arm relative to the boom, and of the bucket relative to the arm. Also provided is memory means for storing a set of fuzzy control rules in the form of membership functions for controlling the boom actuator means and the arm actuator means and the bucket actuator means. Arithmetic means is connected to both converter means and memory means for computing command values for the boom actuator means and the arm actuator means and the bucket actuator means on the bases of the speed signals and the fuzzy control rules. Controller means is connected to both sensor means and arithmetic means for controlling the boom actuator means and the arm actuator means and the bucket actuator means for optimum cutting operation on the bases of the position signals and the command values.

Generally, any skilled operator manually controls the depths of cuts according to the resistance encountered by the bucket as it cuts into the soil. He will take a shallow cut if the soil is hard, and a deep cut if it is soft. The fuzzy control rules stored on the memory means according to the invention are predetermined based on such empirical knowledge of veteran operators.

Each control rule has an antecedent and an apodosis. Each antecedent may include the membership functions of bucket speed relative to the arm, and of arm speed relative to the boom. Each apodosis may include the membership functions of command values to be given to the boom actuator means, the arm actuator means and the bucket actuator means. For automatic cutting, the arithmetic means computes the command values according to the sensed bucket and arm speeds and the control rules, controlling the machine so that the bucket may take a cut in a manner suiting the particular type of the soil.

The above and other features and advantages of this invention and the manner of realizing them will become more apparent, and the invention itself will best be understood, from a study of the following description and appended claims, with reference had to the attached drawings illustrating the best mode of carrying out the invention.

DESCRIPTION OF THE PREFERRED EMBODIMENT

Figure 1:
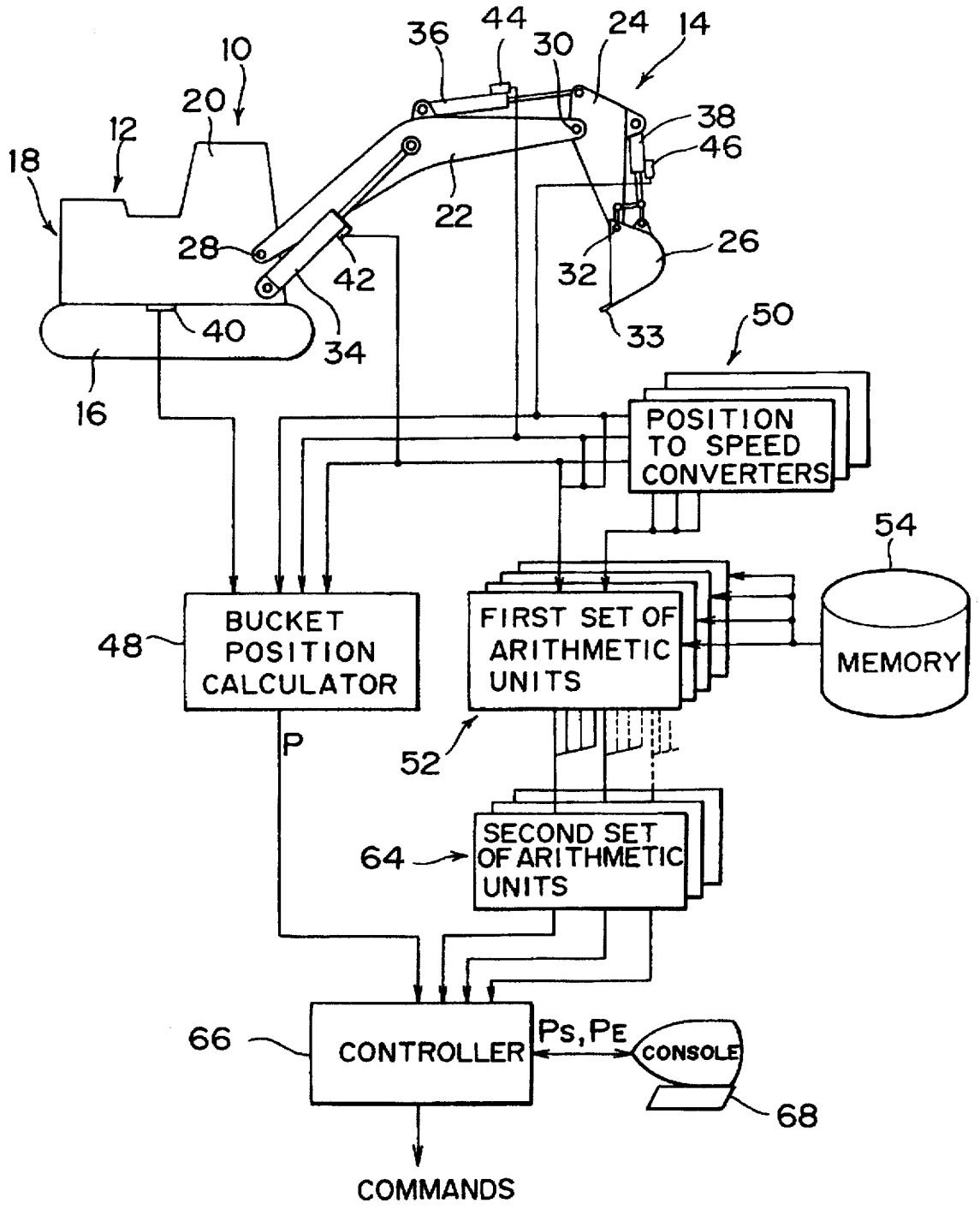
FIG. 1 is a side elevation of a hydraulic backhoe shown together with a block diagram of a fuzzy control system for controlling its operation according to the present invention.

The present invention will now be described more specifically as applied to the hydraulic backhoe shown at 10 in FIG. 1. Broadly, the backhoe 10 comprises a self propelled vehicle 12 and a front end attachment 14. The vehicle 12 is shown as a combination of a track undercarriage 16 and an upper frame 18 including an operator's cabin 20. The upper frame 18 is mounted atop the undercarriage 16 for bidirectional rotation relative to the same about a vertical axis. It is understood that the backhoe 10 conventionally includes hydraulic motors, not shown, for propelling the vehicle 12 and for bidirectionally driving the upper frame 18 relative to the undercarriage 16.

The front end attachment 14 comprises a boom 22, a stick or arm 24 and a bucket 26. The boom 22 has one end pivotally connected at 28 to the frame 18, and the other end pivotally connected at 30 to one end of the arm 24. The other end of the arm 24 is pivotally connected at 32 to the base end of the bucket 26. The bucket 26 has a cutting end 33 away from the base end.

A pair of hydraulic boom jacks 34, one seen, are operatively connected between frame 18 and boom 22 for controlling the pivotal movement of the boom about the pivot 28. The term "hydraulic jack" is herein used in the conventional sense to refer generally to the familiar double acting linear actuator known as a hydraulic cylinder. A hydraulic arm jack 36 is operatively connected between boom 22 and arm 24 for controlling the pivotal movement of the arm about the pivot 30. A hydraulic bucket jack 38 is operatively connected between arm 24 and bucket 26 for controlling the pivotal movement of the bucket about the pivot 32.

The construction of the hydraulic backhoe 10 as so far described is conventional and therein lies no feature of the present invention. The novel features of the invention will appear in the following description of the control system built into the excavator.

Forming parts of the control system according to the invention are a frame revolution sensor 40, a boom angle sensors 42, a arm angle sensor 44 and a bucket angle sensor 46. The frame revolution sensor 40 provides an electric signal indicative of the angular position of the frame 18 with respect to the undercarriage 16. Mounted to one of the boom jacks 34, the boom angle sensor 42 provides an electric signal indicative of the angular position of the boom 22 with respect to the frame 18 on the basis of the extension or contraction of the boom jacks. The arm angle sensor 44 and bucket angle sensor 46 are mounted to the arm jack 36 and the bucket jack 38, respectively, for providing electric signals indicative of the angular positions of the arm 24 with respect to the boom 22 and of the bucket 26 with respect to the arm.

The four sensor 40–46 are all connected to a bucket position calculator 48. Inputting the electric signals from the four sensors, the bucket position calculator 48 geometrically computes the current position of the cutting end 33 of the bucket 26.

The boom angle sensor 42, arm angle sensor 44 and bucket angle sensor 46 are also individually connected to three position to speed converters 50. As the angle sensors 42–46 provide positional information concerning the boom 22, arm 24, and bucket 26, the converters 50 translates such information into corresponding speed data, for delivery to a first set of arithmetic units 52. The position data from the angle sensors 42–46 are also fed directly into the arithmetic units 52.

Also connected to the first set of arithmetic units 52 is a memory 54 which stores the fuzzy Control Rules which have been predetermined on the basis of the empirical knowledge of veteran backhoe operators. The Control Rules stored on the memory 54 may be briefly summarized as follows:

Control Rule I ($V_{bk}$ is PB) and ($V_{am}$ is PB)

($J_{bk}$ is PS) and ($J_{am}$ is PB ) and ($J_{bm}$ is Z)

Control Rule II ($V_{bk}$ is PS) and ($V_{am}$ is PB)

($J_{bk}$ is PB) and ($J_{am}$ is PM) and ($J_{bm}$ is PS)

Control Rule III ($V_{bk}$ is PB) and ($V_{am}$ is PS)

($J_{bk}$ is PS) and ($J_{am}$ is PM) and ($J_{bm}$ is PS)

Control Rule IV ($V_{bk}$ is PS) and ($V_{am}$ is PS)

($J_{bk}$ is PB) and ($J_{am}$ is PB) and ($J_{bm}$ is PM)

In each of the Control Rules given above, the upper line gives an antecedent, and the lower line an apodosis. The abbreviations used in the Control Rules are defined as follows:

$V_{bk}$=bucket speed $V_{am}$=arm speed $V_{bm}$=boom speed $J_{bk}$=bucket control command $J_{am}$=arm control command $J_{bm}$=boom control command PB=positive and big PM=positive and medium PS=positive and small Z=zero.

Thus Control Rule I, for instance, dictates that if the bucket speed is positive and high, and the arm speed is positive and high, then the bucket should be operated positive and small, the arm should be operated positive and large, and the boom should be at rest.

Figure 2:
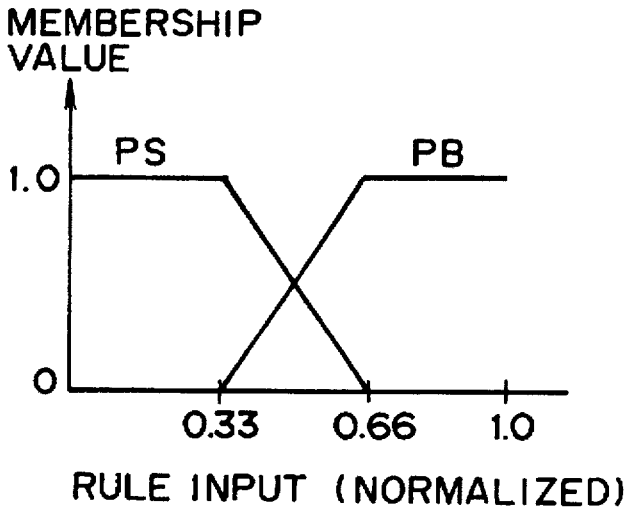
FIG. 2 is a graphic representation of examples of membership functions used in the antecedents of the fuzzy control rules according to the invention.
Figure 3:
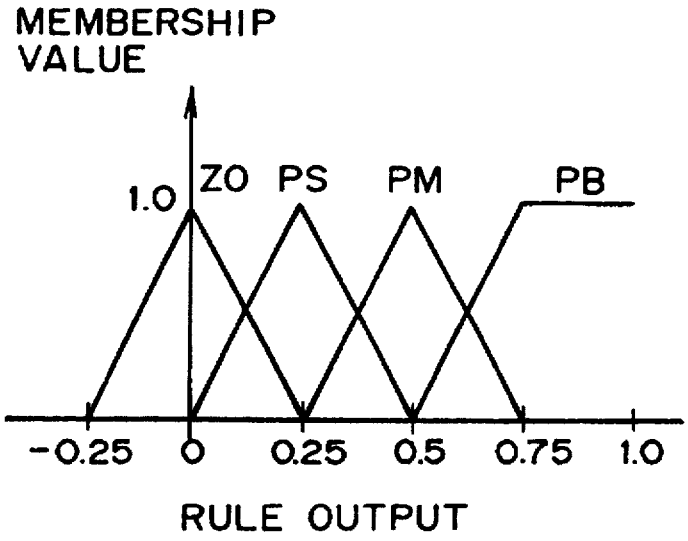
FIG. 3 is a graphic representation of examples of membership functions used in the apodoses of the fuzzy control rules according to the invention.

Actually, since the Control Rules must be expressed numerically, membership functions are employed according to fuzzy theory. FIG. 2 graphically represents the membership functions of PS and PB used in the antecedents of the Control Rules. FIG. 3 is a similar representation of the membership functions of PB, PM, PS and Z used in the apodoses of the Control Rules.

Figure 4A:
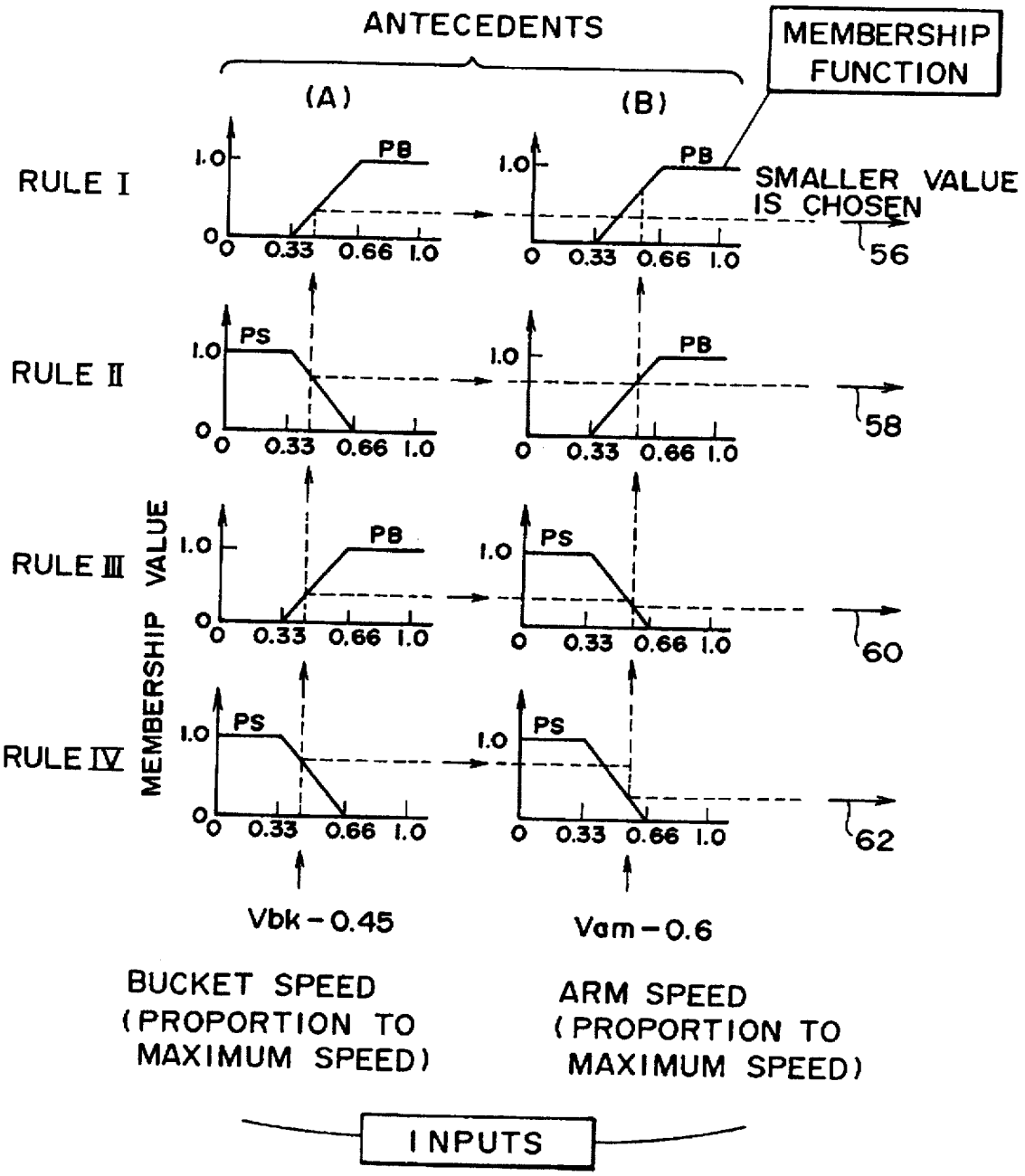
FIGS. 4A and 4B, so divided into two separate sheets of drawing, are graphic representations of all the fuzzy control rules used in the FIG. 1 control system, the views being also explanatory of how the control rules are utilized in the control system.
Figure 4B:
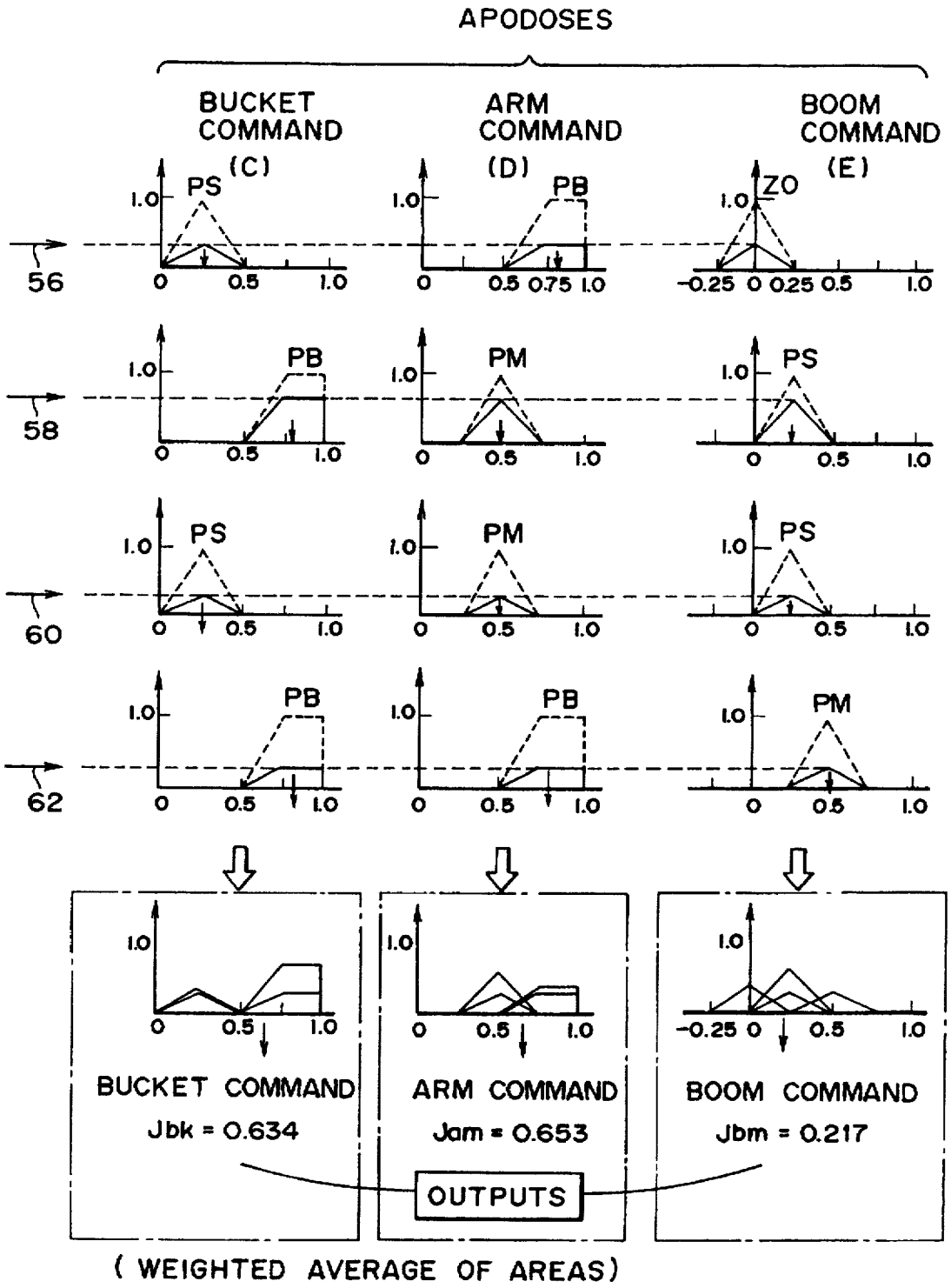

FIG. 4 sets forth the actual membership functions of the four Control Rules. The antecedents and apodoses of the Control Rules are given on two separate sheets of drawing designated FIGS. 4A and 4B. The arrows 56, 58, 60 and 62 indicate the continuities between FIGS. 4A and 4B. Inputting these Control Rules from the memory 54, and the speed data from the converters 50, the arithmetic units 52 function as explained below with reference to FIGS. 4A and 4B.

In response to the incoming data representative of the bucket speed $V_{bk}$ and arm speed $V_{am}$ the arithmetic units 52 first ascertain the corresponding membership values of the membership functions, given at (A) and (B) in FIG. 4A, for the respective Control Rules. Then each arithmetic unit 52 chooses the smaller one of the two ascertained membership values. Then the membership functions of bucket control command $J_{bk}$ arm control command $J_{am}$ and boom control command $J_{bm}$ given at (C), (D) and (E) in FIG. 4B, forming the apodosis of each Control Rule are corrected with the above chosen smaller membership value from the antecedent of the corresponding Control Rule. FIG. 4B shows the uncorrected membership functions of the Control Rule apodoses by the dashed lines, and the corrected membership functions by the solid lines. Then there are determined the centroidal membership values of the corrected membership functions and the control command values for the boom, arm and bucket.

The centroidal membership values and the control command values obtained as above are then directed into a second set of three arithmetic units 64 corresponding respectively to the boom 22, arm 24 and bucket 26. These arithmetic units 64 perform the following equation for obtaining the weighted averages of the input variables:

$$J_i = \Sigma P_n * J_{ni} / \Sigma P_n$$

where $J_i$=final control command values for the boom jacks, arm jack and bucket jack $P_n$=membership value of Control Rule n $J_{ni}$=command value of Control Rule n.

The letter n represents the number of applicable Control Rules. For instance, if $V_{bk}$ is greater than 0.33 and less than 0.66, then $V_{bk}$ is both PS and PB. If $V_{am}$ is also greater than 0.33 and less than 0.66, then $V_{am}$ is also both PS and PB. Therefore, ($V_{bk}$, $V_{am}$) equals (PS, PS), (PS, PB), (PB, PS) and (PB, PB). Accordingly, in this case, n is four. However, if $V_{bk}$ is equal to or greater than 0 and equal to or less than 0.33, and $V_{am}$ is greater than 0.33 and less than 0.66, then $V_{bk}$ is only PS. Therefore, ($V_{bk}$, $V_{am}$) equals (PS, PS) and (PS, PB). Accordingly, in this case, n is two.

The second set of arithmetic units 64 are all connected to a controller 66 for supplying thereto the above computed final control command values for the boom, arm and bucket jacks. The bucket position calculator 48 is also connected to the controller 66 for supplying thereto the data representative of the current position P of the cutting end 33 of the bucket 26. Also connected to the controller 66 is input means herein shown as a control console 68. The operator is to manually input on the control console 68 a desired start position $P_s$ and end position $P_e$ of the bucket end 3 for a cut to be taken.

Figure 5:
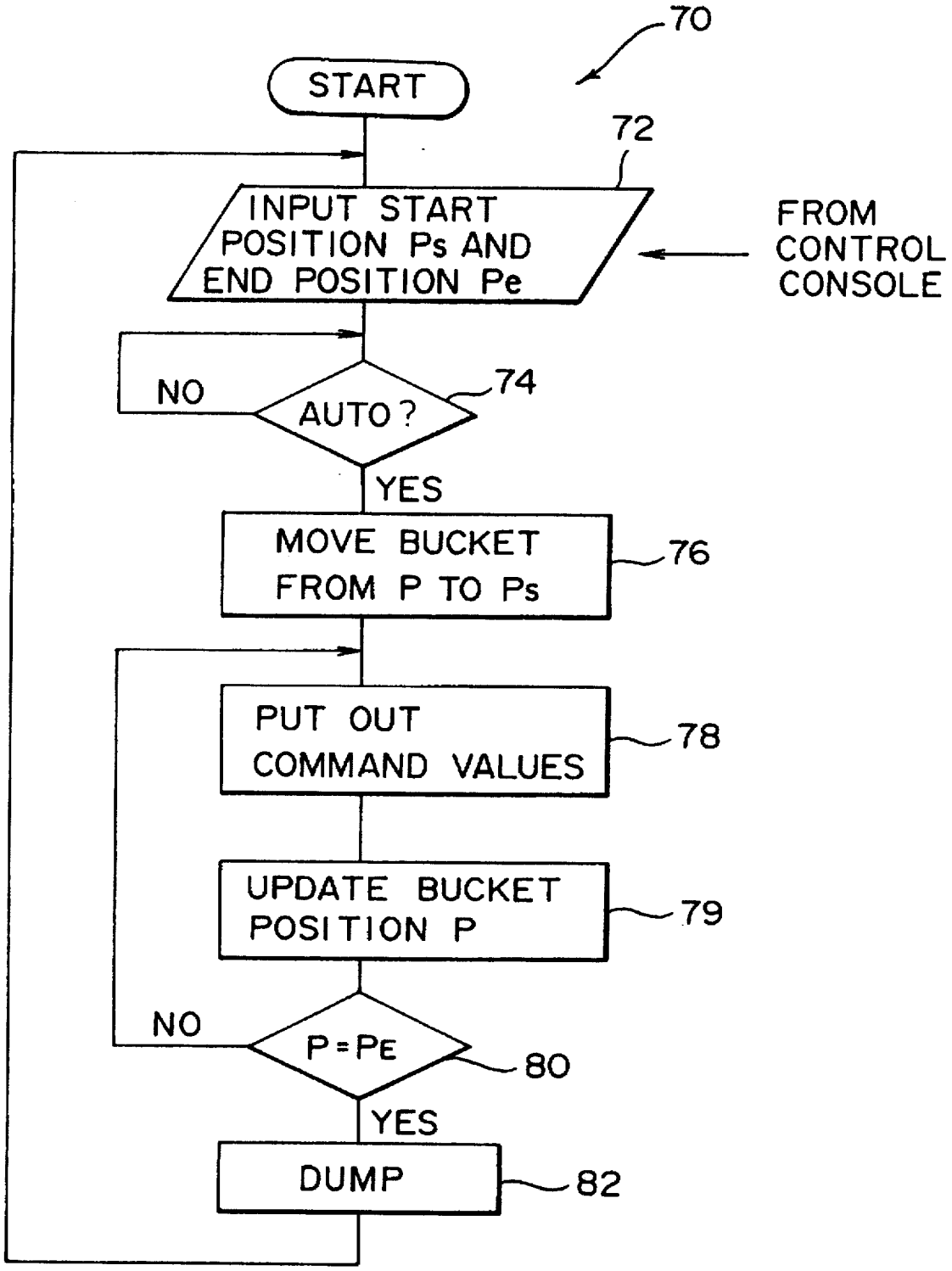
FIG. 5 is a flowchart explanatory of the control program built into the controller in the FIG. 1 control system.

Thus, receiving the current bucket position data P from the bucket position calculator 48, the final control command data from the arithmetic units 64, and the desired bucket position data $P_s$ and $P_e$ from the control console 68, the controller 66 implements its inbuilt control program flowcharted in FIG. 5 and therein generally designated 70. The controller 66 is connected to suitable control and drive means, not shown, for causing the extension and contraction of the hydraulic jacks 34, 36 and 38, as well as the bidirectional rotation of the unshown hydraulic motor for the revolution of the frame 18, in response to the commands from the controller. Given hereafter is the discussion of the control program 70 introduced into the controller 66.

At 72 in the control program 70 there are input the desired start position $P_s$ and end position $P_e$ of the cutting end 33 of the bucket 26 for a cut to be taken. A logical node 74 entitled "Auto" is next encountered which commands the machine to initiate cutting in the auto mode. At the next block 76 the controller 66 responds to the automatic cutting command by causing the machine to move the bucket end 33 from its current position P to the desired start position $P_s$.

Actual cutting of the soil will be initiated as the controller 66 subsequently causes at a block 78 the controlled operation of the boom, arm and bucket jacks according to the final control command values received from the second set of arithmetic units 64. It should be noted that unlike the prior art, the bucket will not follow a predetermined locus from start position $P_s$ to end position $P_e$ but will trace a variable path under the fuzzy control according to the invention. Thus the machine will cut a varying amount of soil depending upon its nature and so operate most efficiently as if under the manual control of a veteran operator.

During the progress of such cutting operation the current bucket position data from the bucket position calculator 48 is constantly updated, as at a block 78, so that the controller 66 knows at every instant the current position P of the bucket end 33. Then, at a logical node 80, the controller 66 determines whether the current bucket position P is equal to the desired end position P. The controller repeats the production of the final command values until the current position P equals the desired end position $P_e$. The next block 82, to which the control program proceeds upon completion of the desired cutting stroke, is conventional as the bucket is subsequently transferred to a desired unloading position and dumped as has been known heretofore. One cycle of automatic bucket loading and unloading operations has now been completed, and the same cycle may be repeated thereafter.

Although the present invention has been shown and described highly specifically and as embodied in a hydraulic backhoe, it is recognized that the invention admits of a variety of departures from the illustrated embodiment. The fundamental concepts of this invention may be applied to other types of excavators or earthmovers. Also, in the illustrated embodiment, the angle sensors 42, 44 and 46 may determine the angular positions of the boom, arm and bucket not from the extensions or contractions of the hydraulic jacks but directly from the angles of the boom relative to the frame, of the arm relative to the boom, and of the bucket relative to the arm. Various other modifications, alternations and adaptations of this invention may be resorted to without departing from the proper scope or fair meaning of the subjoined claims.

What is claimed is:

1. A method of automatically controlling a cutting operation of an excavator having a boom pivotally coupled at one end to a vehicle, an arm pivotally connected at one end to another end of the boom, a bucket having a base end and a cutting end and pivotally connected at the base end to another end of the arm, boom actuator means for pivoting the boom relative to the vehicle, arm actuator means for pivoting the arm relative to the boom, and bucket actuator means for pivoting the bucket relative to the arm, said method comprising the steps of:

(a) determining a current position of the cutting end of the bucket;

(b) causing the boom actuator means and the arm actuator means and the bucket actuator means to move the cutting end of the bucket to a desired start position of a cut to be taken;

(c) initiating the cutting operation;

(d) determining a first angular speed of the bucket relative to the arm and a second angular speed of the arm relative to the boom; and (e) providing a set of fuzzy control rules in the form of membership functions, wherein each control rule includes an antecedent and an apodosis, and the set of fuzzy control rules is predetermined based on empirical knowledge associated with a type of soil;

(f) controlling the boom actuator means and the arm actuator means and the bucket actuator means in accordance with the first angular speed, the second angular speed, and the set of fuzzy control rules so as to control the cutting operation of the excavator.

2. A method of automatically controlling a cutting operation of an excavator having a boom pivotally coupled at one end to a vehicle, an arm pivotally connected at one end to another end of the boom, a bucket having a base end and a cutting end and pivotally connected at the base end to another end of the arm, boom actuator means for pivoting the boom relative to the vehicle, arm actuator means for pivoting the arm relative to the boom, and bucket actuator means for pivoting the bucket relative to the arm, said method comprising the steps of:

(a) providing a set of fuzzy control rules each having an antecedent and an apodosis, each antecedent including membership functions of an angular bucket speed relative to the arm and an angular arm speed relative to the boom, each apodosis including membership functions of respective command values to be supplied to the boom actuator means and the arm actuator means and the bucket actuator means;

(b) providing sensors signals indicative of a boom angle, an arm angle and a bucket angle;

(c) computing the angular speed of the bucket relative to the arm and the angular speed of the arm relative to the boom based on the sensor signals;

(d) providing the computed angular bucket speed and angular arm speed to the membership functions of the antecedent of each fuzzy control rule in order to determine corresponding membership values;

(e) choosing smaller one of the membership values determined at step (d) for each fuzzy control rule;

(f) correcting the membership functions of the apodosis of each fuzzy control rule with the smaller one of the membership values of the same fuzzy control rule chosen at step (e);

(g) determining centroidal values of the corrected membership functions of the apodosis of each fuzzy control rule;

(h) determining weighted averages of the centroidal values of the corrected membership functions of all the fuzzy control rules; and (i) controling the boom actuator means and the arm actuator means and the bucket actuator means on the weighted averages determined in step (h) so as to control the cutting operation of the excavator.

3. An excavator for performing an automatic cutting operation under fuzzy control, comprising:

(a) a vehicle;

(b) a boom pivotally coupled at one end to the vehicle;

(c) an arm pivotally connected at one end to another end of the boom;

(d) a bucket having a base end and a cutting end and pivotally connected at the base end to another end of the arm;

(e) boom actuator means for pivoting the boom relative to the vehicle;

(f) arm actuator means for pivoting the arm relative to the boom;

(g) bucket actuator means for pivoting the bucket relative to the arm;

(h) sensor means for providing position signals indicative of respective angular positions of the boom relative to the vehicle, of the arm relative to the boom, and of the bucket relative to the arm;

(i) converter means connected to the sensor means for translating the position signals into speed signals indicative of angular speeds of the boom relative to the vehicle, of the arm relative to the boom, and of the bucket relative to the arm;

(j) memory means for storing a set of fuzzy control rules in the form of membership functions for controlling the boom actuator means and the arm actuator means and the bucket actuator means;

(k) arithmetic means connected to the converter means and the memory means for computing command values for the boom actuator means and the arm actuator means and the bucket actuator means on the basis of the speed signals and the fuzzy control rules; and (l) controller means connected to the sensor means and the arithmetic means for controlling the boom actuator means and the arm actuator means and the bucket actuator means for performing the automatic cutting operation on the basis of the position signals and the command values.

4. An excavator for performing an automatic cutting operation under fuzzy control, the excavator comprising:

(a) a vehicle;

(b) a boom pivotally coupled at one end to the vehicle;

(c) an arm pivotally connected at one end to another end of the boom;

(d) a bucket pivotally connected to another end of the arm, the bucket having a base end and a cutting end and connected at the base end to the arm;

(e) boom actuator means for pivoting the boom relative to the vehicle;

(f) arm actuator means for pivoting the arm relative to the boom;

(g) bucket actuator means for pivoting the bucket relative to the arm;

(h) sensor means for providing position signals indicative of respective angular positions of the boom relative to the vehicle, of the arm relative to the boom, and the bucket relative to the arm;

(i) calculator means connected to the sensor means for computing current position of the cutting end of the bucket on the basis of the position signals;

(j) converter means connected to the sensor means for translating the position signals into speed signals indicative of angular speeds of the boom relative to the vehicle, of the arm relative to the boom, and of the bucket relative to the arm;

(k) memory means for storing a set of control rules in the form of membership functions for controlling the boom actuator means and the arm actuator means and the bucket actuator means;

(l) arithmetic means connected to the converter means and the memory means for computing command values for the boom actuator means and the arm actuator means and the bucket actuator means on the basis of the speed signals and the control rules;

(m) input means for manually inputting a desired start position and end position of the cutting end of the bucket for a cut to be taken; and (n) controller means connected to the calculator means and the arithmetic means and the input means for controlling the boom actuator means and the arm actuator means and the bucket actuator means so that the bucket may perform the automatic cutting operation from the desired start position to the end position.

5. The excavator of claim 4 wherein each control rule stored on the memory means has an antecedent including membership functions of the angular speeds of the bucket and the arm, and an apodosis including membership functions of command values to be given to the boom actuator means and the arm actuator means and the bucket actuator means.

* * * * *